United States Patent [19]

Owens

[11] Patent Number: 4,809,533

[45] Date of Patent: Mar. 7, 1989

[54] TRANSFER APPARATUS FOR STRAIGHT SIDE PRESS AND METHOD

[76] Inventor: Roland G. Owens, 10850 Hall Rd., Hamburg, Mich. 48139

[21] Appl. No.: 570,998

[22] Filed: Jan. 16, 1984

Related U.S. Application Data

[63] Continuation-in-part of Ser. No. 341,595, Jan. 22, 1982, Pat. No. 4,428,221.

[51] Int. Cl.[4] ..... B21J 11/00

[52] U.S. Cl. ..... 72/405; 72/420; 72/422

[58] Field of Search ..... 72/405, 420, 422, 427, 72/446, 448; 29/401.1

[56] References Cited

U.S. PATENT DOCUMENTS

| | | | |
|---|---|---|---|
| 814,054 | 3/1906 | Lamb | 72/405 |
| 2,279,417 | 4/1942 | Stevens | 72/405 |
| 3,512,391 | 5/1970 | Bozich | 72/405 |
| 3,541,834 | 11/1970 | Wallis | 72/405 |
| 3,969,918 | 7/1976 | Bernotus et al. | 72/427 |
| 4,003,237 | 1/1977 | O'Keefe | 72/405 |
| 4,326,402 | 4/1982 | Wallis | 72/344 |

*Primary Examiner*—Frederick R. Schmidt
*Assistant Examiner*—Robert Showalter
*Attorney, Agent, or Firm*—Cullen, Sloman, Cantor, Grauer, Scott & Rutherford

[57] ABSTRACT

In a straight side press having a bed, a reciprocal slide, a power drive for the slide and apparatus for feeding a stock strip onto the dies, and a conventional die set, the improvement of modifying the press to function as a transfer press by replacing the conventional die set with a transfer unit. The unit includes a plurality of longitudinally spaced sequential dies upon a lower die shoe having a sub-plate secured to the bed to define a series of stations. A plurality of corresponding spaced sequential punches are mounted upon an upper die shoe and secured to the slide. A pair of slide bars are reciprocally mounted upon the lower die shoe outwardly of the dies mounting pairs of opposed workpiece gripping fingers adapted for engagement with the respective workpieces at each station. The transfer unit includes a slide bar translator mounted upon the sub-plate and has a reciprocal end plate connected to the slide bars for intermittently transferring the workpieces from station to station. The translator is adapted for alternately moving the slide bars towards and away from each other. The method of modifying a straight side press includes removal of the die set therefrom and replacing it with a transfer unit, so that the modified straight side press functions as a transfer press.

3 Claims, 4 Drawing Sheets

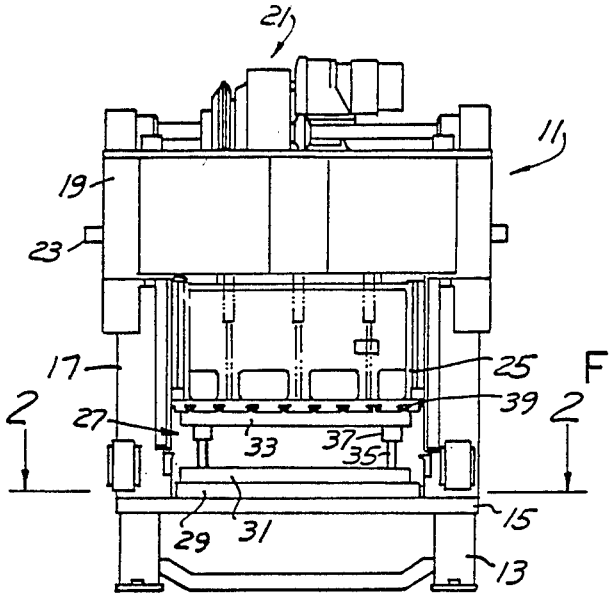
FIG. 1
FIG. 2
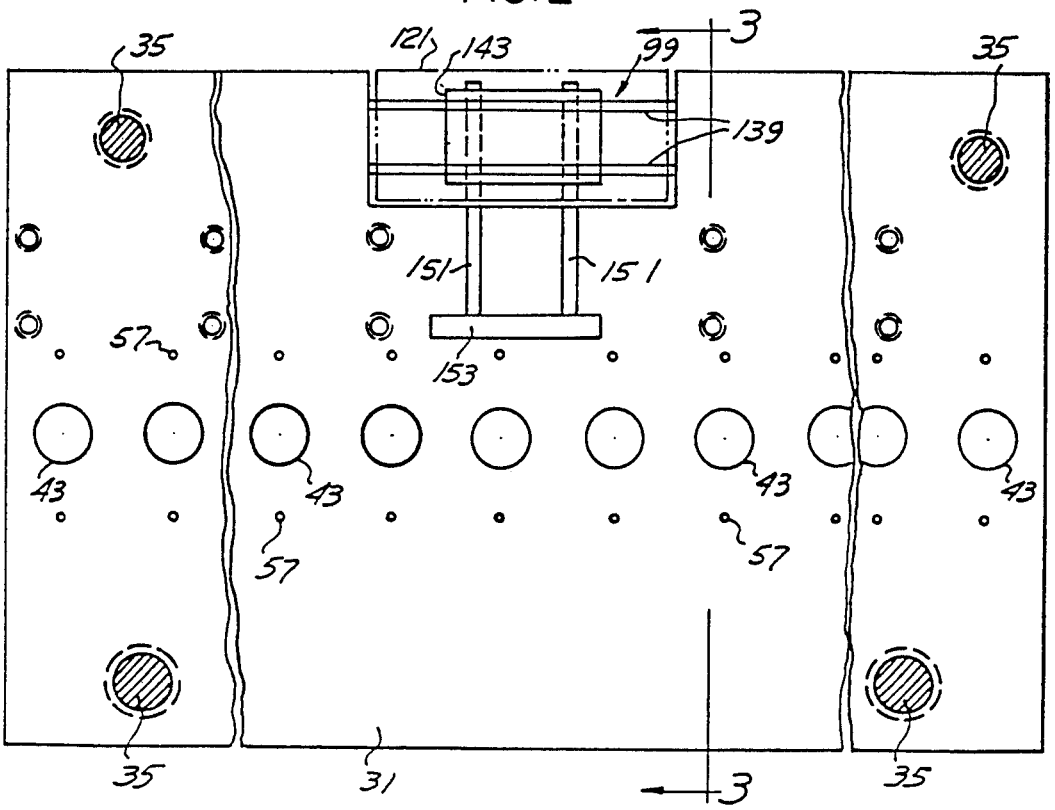

TRANSFER APPARATUS FOR STRAIGHT SIDE PRESS AND METHOD

This is a continuation-in-part of my copending patent application, Ser. No. 341,595, filed Jan. 22, 1982, now U.S. Pat. No. 4,428,221.

BACKGROUND OF THE INVENTION

Heretofore in conventional presses for single operation or with progressive dies, there is normally employed a bed, a reciprocal slide, a power drive for the slide and apparatus for feeding a stock strip onto the dies on the bed. Normally, the outer edges or some portion of the strip remains intact longitudinally and moves the parts from station to station through final forming. A die set including a die or plurality of longitudinally spaced progressive dies are mounted upon a lower disc shoe and secured to the bed. There is a corresponding punch for each die secured to the upper shoe and connected to the reciprocal slide. Conventional feed means are provided for positioning the stock in the die and for removing the formed articles after a number of reciprocations of the punches and intermittent advances of the stock. These presses are very expensive and can range $150,000 to $800,000 new.

Heretofore there has also been employed transfer presses which alone are similarly expensive and include a die set having a series of longitudinally spaced sequential dies secured upon the lower die shoe and anchored to the bed, and a corresponding series of punches secured to the reciprocal side, together with a transfer mechanism built into the press for intermittently moving the respective workpieces from one station to the next. This press cannot perform the motion and functions of conventional presses and range in cost 25%/50% more than conventional press new.

Heretofore for progressive dies used in a conventional press, after a series of incremental feed movements of the strip of stock and reciprocations of the punches, the finally formed part is separated from the feed strip of stock and ejected, with additional successive formed parts separated from the feed strip after the last forming and ejected. Additional successive formed parts are separated after the last forming in a continuous operation.

There are certain types of work that cannot be properly formed in the conventional press employing progressive dies. These are parts normally that have increased transverse dimensions in the shoulders and can only be formed in a transfer press.

In such type of work, a transfer press is used, i.e., a completely different press. Here blanks are individually delivered to the first die station. After a first punching operation, with all of the punches retracted, a transfer mechanism is employed to grip the workpiece or a series of partly formed workpieces and simultaneously move it or them to the next adjacent station ready for the next downward movement of the corresponding punch and to disengage from the workpiece. Unlike progressive dies in a conventional press, there is no continuous work supporting strip which continuously moves over the dies. Transfer presses can only do one job for a particular workpiece with a plurality of sequential formation therein and wherein there is a predetermined pitch or distance between work stations. For a different workpiece and a different pitch distance, there is required the removal of all of the drive apparatus which is usually a permanent part of the transfer press at its opposite ends as well as specific transfer apparatus at the intermediate die space. All of this must be done before the transfer press has added thereto a new die set for a different product and possibly for a different pitch. Such a change normally takes four men working all day for a week. This includes modification of mechanical parts, the electrical parts, the air control parts and the switches. Once a transfer press has been tooled for a particular job, it is highly expensive and time consuming to modify such press for different tooling or dies.

SUMMARY OF THE INVENTION

The objectof the present invention is to be able to employ a conventional press with a Progressive Die Set with its conventional functions which can be converted to a transfer press by substituting a transfer unit replacing the Progressive Die set.

A transfer mechanism is part of the transfer unit which includes a pair of slide rails or bars with grippers. The gripper fingers are arranged upon opposite sides of the row of individual dies, together with a translator adapted for effecting reciprocal movements of the slide bars for transferring the workpieces from station to station successively. Alternatively and in some cases cams provide the function of moving the slide bar towards and away from each other. The gripping fingers are normally spaced from the workpieces until the time of transfer.

It is a further feature of the present invention to modify a straight side press by replacing the conventional die set assembly upon the machine bed with a transfer unit assembly. Such unit includes a plurality of longitudinally spaced sequential dies secured upon a lower die show upon a sub-plate to define a plurality of spaced die stations; and attaching to the reciprocal upper slide an upper die shoe mounting a plurality of depending longitudinally spaced punches for operative registry with the dies respectively.

A further feature includes a pair of elongated horizontal slide bars which are reciprocally mounted upon the lower die shoe arranged outwardly of the dies, with opposed pairs of a workpiece gripper fingers, pivotally mounted upon the slide bars and in registry with each of the stations and adapted for engaging registry with the respective sequentially formed workpieces at each station.

A further feature incorporates the use of a slide bar translator mounted upon the sub-plate and secured to the slide bars for intermittently reciprocating the slide bars and fingers between adjacent stations for sequentially transferring the workpieces through all stations.

Another feature includes modified slide bars employing stationery grippers normally spaced from the workpieces. The slide bar translator is adapted for the further function of moving the slide bars towards and away from each other for intermittently gripping the respective partially formed workpieces and successively transferring said workpieces simultaneously from one station to the next adjacent station, thereafter disengaging the slide bars and gripper fingers from the workpieces.

A further feature is to provide a slide bar translator which is itself available on the market and which can be utilized for effecting reciprocal or compound movements to the slide bars and wherein the transfer unit modifies a conventional press for transfer functions while maintaining the press for conventional use by removing the transfer unit.

An important feature is to provide a transfer unit as an entity which includes a lower die shoe mounting a plurality of longitudinally spaced sequential dies, with the die shoe having a sub-plate mountable upon the bed of a straight side press. The transfer unit includes an upper die shoe having a series of spaced depending sequential punches with the upper die shoe mounted upon the reciprocal slide of the press. The transfer unit further includes a pair of spaced slide bars mounted upon the lower die shoes and arranged upon opposite sides of the dies having opposed pairs of workpiece gripping fingers. A translator is mounted upon the sub-plate and has a longitudinally reciprocal plate secured to the slide bars for effecting successive reciprocal longitudinal movements. The translator is also adapted upon some modification for adding alternate transverse motions for successively and alternately retracting the slide bars with respect to the workpieces and for incrementally gripping and transferring the workpieces from one station to the next succeeding station.

The present invention contemplates that the conventional straight side press may be modified to do the functions of a transfer press by first removing the conventional die set of the straight side press and substituting the above transfer unit with whose lower die shoe is mounted upon and secured to the bed and whose upper die shoe is connected to the reciprocal vertical slide. Thereafter the transfer unit after it has served its functions, it may be removed from the straight side press and replaced by the conventional die set. The press is then capable of functioning as a conventional press. The tie involved for two men in making the change, removing the conventional die set and substituting the present transfer unit is to two hours, approximately. Alternately, the removal of the transfer unit from the straight side press and replacing it by the conventional die set again only takes two men at most up to two hours.

A further feature includes the method of modifying the conventional straight side press so as to perform the functions of a transfer press.

These and other features and objects will be seen from the following Specification and claims in conjunction with the appended drawings.

THE DRAWINGS

FIG. 1 is a fragmentary front elevational view of a conventional straight side press adapted for progressive die use.

FIG. 2 is a fragmentary plan view, on an increased scale, of the lower die shoe and translator of the present transfer unit, taken in the direction of arrows 2—2 of FIG. 1.

Figure 3:
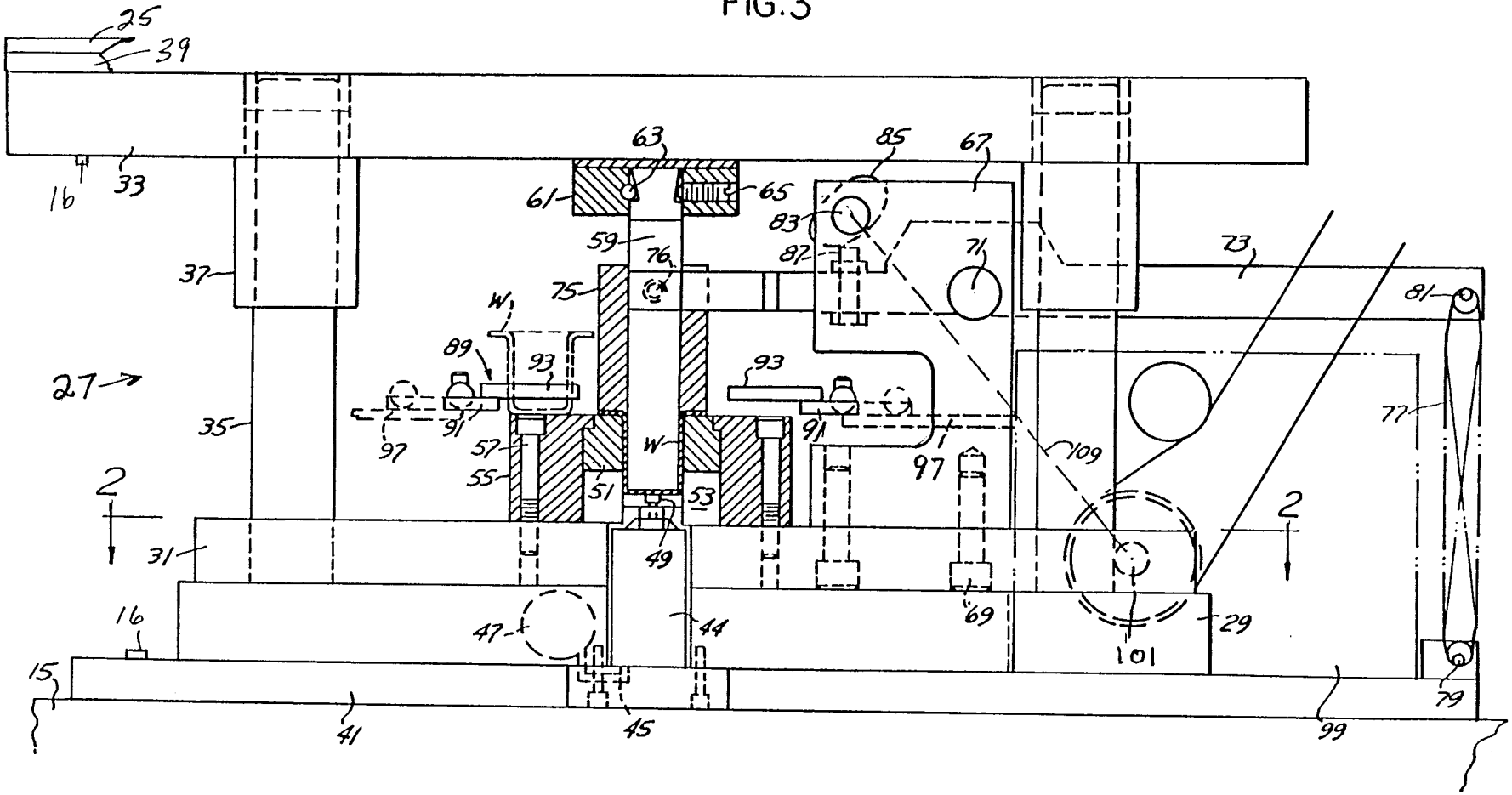
FIG. 3 is a fragmentary vertical section of the present transfer unit on an increased scale, taken through the center of one of the stations in the direction of arrows 3—3 of FIG. 2.

It will be understood that the above drawings illustrated merely preferred embodiments of the invention and the present method, and that other embodiments are contemplated within the scope of the claims hereafter set forth.

DETAILED DESCRIPTION OF AN EMBODIMENT OF THE INVENTION

Referring to the drawings and particularly FIG. 1, a conventional straight side press 11 has a base 13, bed 15, opposed upright sides 17, a crown 19 mounting a power drive assembly 21 and including the power rotated crank shaft 23 connected to the slide 25 guidably mounted upon the opposed sides 17 for intermittent reciprocal movements.

The straight side press in the illustrative embodiment normally uses a conventional die set including a series of spaced dies, a lower die shoe and a sub-plate mountable upon the bed 15. Also includes an upper die shoe mounting a series of spaced punches which are connected to the reciprocal vertical slide. The straight side press is converted to a transfer press by replacing said conventional die set with the present transfer unit 27, FIGS. 1 and 3. Said transfer unit includes a series of longitudinally spaced dies 51 which are located at the stations 43, one of said dies being shown in section in FIG. 3. The transfer unit includes an elongated manifold 29 which is air or nitrogen pressurized, mounted upon sub-plate 41. The sub-plate is mounted upon and secured to the machine bed 15 by fasteners 16. Conventional clamps may also be used. The lower die shoe 31, as a part of the transfer unit, is mounted upon manifold 29 and secured thereto.

Upon die shoe 33, as a part of the transfer unit, is spaced directly above lower die shoe 31. A plurality of upright guide pins 35 are secured to the lower die shoe and guidably extend through a plurality of bushings 37 suitably secured, as by bolting, to the underside of the upper die shoe 33 for guiding the reciprocal movements of the upper die shoe and for at all times maintaining the punches 59 in axial registry with the corresponding dies 51 at the respective stations 43. Except for the bed 15, T-slotted face 39 and slide 25, fragmentarily shown, the complete transfer unit is shown in FIG. 3.

The "T" slotted face 39 underlies the reciprocal slide 25 and is suitably secured to the upper die shoe 33, FIG. 1. A plurality of longitudinally spaced ejector cylinders 44 are arranged at each of the stations 43 and are in axial registry with the corresponding die 51, FIG. 3.

Conduits 45 in the mounting plate of each cylinder interconnect the respective cylinders with the interior of the manifold 29 for pressurizing each cylinder. The manifold 29 is connected to an exterior source of pressurized nitrogen or air pressure such as shown schematically at 47.

Each of the ejector cylinders includes a conventional ejector pin 49 in axial registry with die 51. Each die is mounted upon a suitable spacer 53 upon lower die shoe 31 and secured thereon by a die retainer 55 anchored to die shoe 31 by a series of fasteners 57. For each of the series of longitudinally spaced dies 51 mounted at the respective stations 43, FIG. 2, there is provided a die retainer 55 for anchoring the respective die to the lower die shoe. By this construction, the dies 51 are removably mounted upon the lower die shoe and can be individually removed and replaced as desired without effecting the mounting and anchoring of other dies in the set.

The corresponding plurality of longitudinally spaced punches 59 are in axial cooperative registry with the respective dies 51, and at their upper ends are each anchored within a punch holder 61 by by the ball lock 63 or set screw 65, FIG. 3. The respective punch holders are secured to and underlie upper die shoe 33.

As is conventional in presses of this nature, there is provided a pair of longitudinally spaced stripper arm support blocks 67 mounted upon the lower die shoe 31 and secured thereto by fasteners 69. Support shaft 71 for the stripper arms extends between and is mounted upon the support blocks 67 and is suitably secured thereto.

A series of transversely spaced parallel stripper arms 73 corresponding to the respective stations 43, intermediate their ends are mounted upon shaft 71. Conventional cylindrical strippers 75 axially receive the respective punches 59, and are flexibly secured as at 76 to the inner ends of the corresponding stripper arms 73.

The outer ends of the respective stripper arms are normally biased in a clockwise direction by the lift springs 77, anchored at 79 to the sub-plate 41 and at 81 to the outer ends of the corresponding stripper arm 73.

Transverse power rotated cam shaft 83 spans the respective support blocks 67, and mounts a plurality of stripper release cams 85 in registry with each of the stripper arms, adapted to operatively engage the adjusting screws 87 on each of the respective stripper arms. This is for intermittently rotating the stripper arms in a counterclockwise direction for the stripping function. This separates the workpiece W, which is formed or partially formed at a particular station, from the punch after the punch has been elevated by the upper die shoe so as to clear the finished workpiece and in the dash line displaced position shown in FIG. 3.

With the manifold 29 pressurized at all times, the respective ejector pins 49 are at all times biased upwardly so that upon withdrawal of the correspondingn punch 59, a partly formed workpiece, as the case may be at a particular station, is ejected from the die 51.

Figure 4:
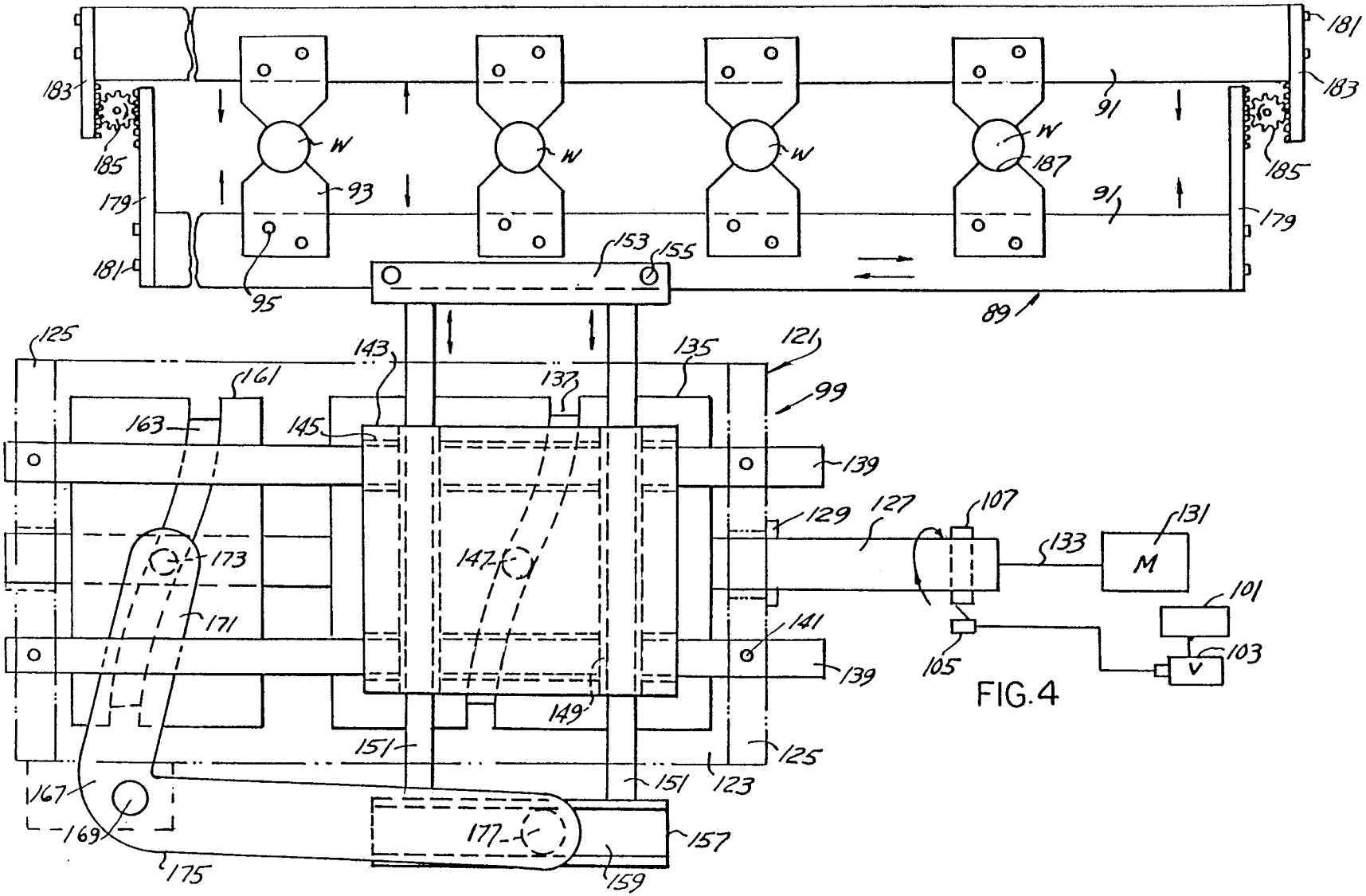
FIG. 4 is a fragmentary plan view of the pair of horizontal slide bars reciprocally mounted upon opposite sides of sequential dies and connected to a translator adapted for effecting in and out movements and successive alternate longitudinal reciprocal movements of the slide bars.
Figure 5:
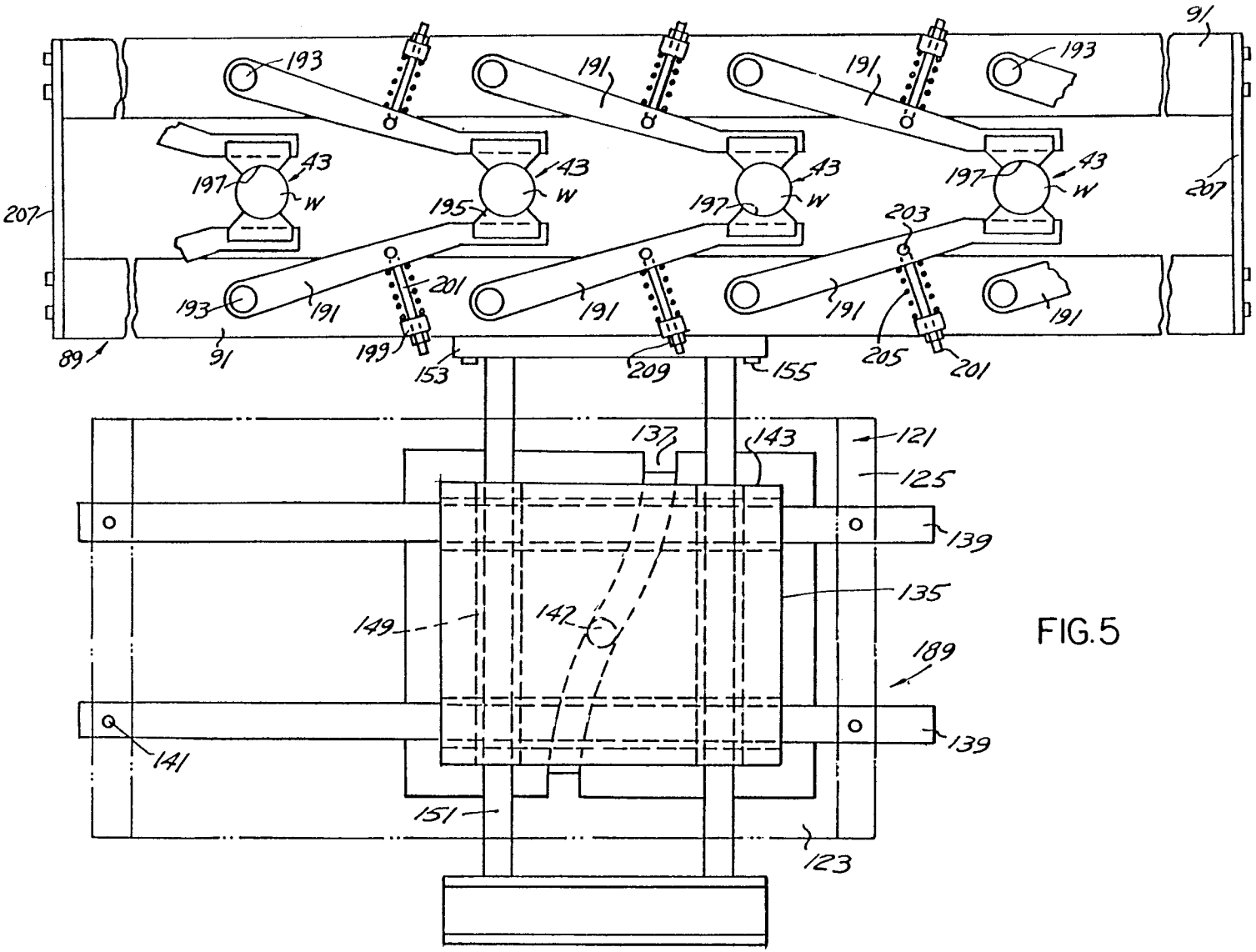
FIG. 5 is a plan view of a translator, similar to FIG. 4, the translator being limited to longitudinal reciprocal movements for the slide bars.

In order to further utilize the conventional straight side press so as to function as a transfer press, there is provided a transfer assembly 89, FIGS. 3, 4 and 5 for the sequentially formed workpieces W. It's primary function is transferring the workpiece from one station to the next station of a series of longitudinally spaced stations, as designated schematically at 43, FIG. 2. The transfer assembly 89 is a part of the present transfer unit 27, FIGS. 1 and 3.

For this purpose there is provided a pair of walking beams or slide bars 91, FIG. 4, which are reciprocally and slidably mounted upon the lower die shoe such as upon slide bar support 97 which extends longitudinally of the upper and lower die shoes. Said slide bars are arranged upon opposite sides of the series of stations 43 outwardly of the respective series of longitudinally spaced dies 51.

Slide bars 91 are adapted to move sequentially in a rectangular path under the control of the translator 99 mounted upon the subplate 41, schematically shown in FIG. 3, and on an enlarged scale in FIG. 4. Said translator is also a part of the transfer unit.

Mounted upon the opposed slide bars 91 corresponding to each of the stations 43, there are opposed longitudinal spaced pairs of workpiece gripper fingers 93 secured to the slide bars by fasteners 95. The respective fingers are normally arranged outwardly of the corresponding workpieces W at their respective stations. In the position of the slide bars 91, FIG. 4, they have been moved towards each other to operatively engage the respective workpieces.

Thus, after the stations operations and retraction of the punches with the partially formed workpieces stripped from the punches, they are automatically transferred longitudinally to the next adjacent station 43.

The present slide bar translator is a product that is available on the market, is manufactured by Stelron Cam Company, Saddlebrook, N.J.

In connection with the opertion of the stripper arms 73, FIG. 3, there is an air or hydraulic motor 101 with control valve 103, actuated through a switch 105, operated by a cam 107 on shaft 127, FIG. 4. Motor 101, through a suitable linkage 109, FIG. 3, rotates shaft 83 mounting cam 85, which is timed to raise the stripper arm above the part just before transfer.

The present translator 99 is employed for effecting a predetermined longitudinal feed and in some cases corresponding in and out movements of the slide bars. Said translator includes a housing 121, FIG. 4 and 5, base 123 on sub-plate 41 and a pair of upright end plates 125. Power driven shaft 127 extends through said end plates and is journaled through corresponding bearings 129 in said end plates and is coupled as at 133 to the motor 131, or power-source schematically shown in FIG. 4. A first barrel cam 135 having a predetermined first cam groove 137 is positioned within said housing and secured to power driven shaft 127 for rotation therewith. A pair of longitudinally spaced parallel guide rods 139 span the respective end plates 125 and are secured thereto at 141.

Longitudinally reciprocal slide 143 includes longitudinal bushings 145 slidably mounted upon the guide rods 139. Feed pin 147 depends from slide 143 and is guidably positioned within first cam groove 137 for effecting longitudinal reciprocal movements of slide 143 on rotation of cam 135.

A pair of parallel spaced transverse bushings 149 extend through slide 143, above the guide rods 139 and receive the pair of transverse feed rods 151 which slidably extend therethrough. End plate 153 spans the inner ends of the feed rods 151 and is suitably secured thereto. End plate 153 overlies the adjacent slide bar 91 and is secured thereto by fasteners 155. Accordingly, intermittent reciprocal longitudinal movements of slide 143 will effect corresponding reciprocal longitudinal movements of the slide bars 91. The opposite ends of the transverse feed rods 151 are interconnected by the infeed block 157 which has upon its undersurface the elongated longitudinal slot 159.

A second barrel cam 161 having a second preformed cam groove 163 therein is positioned within said housing and secured upon driven shaft 127, spaced from the first barrel cam 135. Cantilever 167 intermediate its ends is supportably journaled at 169 upon an axis which is at right angles to driven shaft 127. Said cantilever includes an inner arm 171 which at one end mounts cam pin 173 which extends from said arm and into the second cam groove 163 of the second barrel cam 161.

The other arm 175 mounts at its outer end feed pin follower 177 which is movably positioned within the elongated slot 159 in feed block 157. Accordingly, continuous rotary movements of the second barrel cam 161 are adapted to effect a predetermined rocking movement of the cantilever 167 with the cam groove 163 formed with such sufficient dwell construction that at the correct timing, there will be an initial inward feed movement of block 157 and connected transverse feed rods 151 and the attached end plate 153 connected to one of the slide bars 91.

The slide bars 91 are mounted and constructed in such a fashion that in this illustration, inward feed movement of the slide bar 91 adjacent end plate 153 will cause a corresponding simultaneous inward movement of the other slide bar 91. For this purpose there is provided upon the corresponding opposite ends of the slide bars 91, spaced rack gears 179 and 183 secured at 181. Pinions 185 are in mesh with the opposed rack gears 179 and 183.

Inward movements of end plate 153 will effect simultaneous inward movements of the respective slide bars 91 until the corresponding opposed workpiece gripper fingers 93 operatively engage the corresponding sequentially formed workpieces W. This in and out feed movement is controlled by the second barrel cam 161 with its corresponding preformed cam groove 163. In FIG. 4 groove 137 is shown 180° out of phase with respect to cam groove 163, for clarity.

Once the workpieces have been operatively engaged by the workpiece gripping fingers 93, the slide 143 controlled by cam 135 will be fed longitudinally to the right of FIG. 4 and which corresponds to the left for FIG. 2, for transferring the respective workpieces to the next adjacent station. At that point, the second barrel cam 161 will further function successively to retract the workpiece gripping fingers 93 to disengage the workpieces. Thereafter, the first barrel cam 135 will further function to return the slide bars simultaneously in the opposite direction back to the initial position. The transfer assembly is ready to again engage the workpieces after each forming stroke of the press until each of the workpieces have been sequentially transferred through all stations.

Modified slide bar translator 189 in FIG. 5 is constructed for effecting only reciprocal movements of the corresponding slide bars 91. Accordingly, the second barrel cam 161, shown in FIG. 4, for effecting in and out movements, is not in use or shown in FIG. 5.

In this case there are pivotally mounted at 193 upon each of the slide bars 91 opposed pairs of workpiece gripping finger 191 having arcuate grips 195 at their inner ends normally in registry with each of the respective longitudinally spaced stations 43. Said fingers are in a plane corresponding to the vertical elevated ejected, schematically displaced, workpiece shown in dash lines in FIG. 3. This is a displaced position. Normally the workpiece when separated from a lower die is in a position of axial registry with the lower die directly above the workpiece W shown in FIG. 3. Primarily, the illustration of the workpiece in dash lines in FIG. 3 is merely to show the vertical height of the workpiece as it is engaged by the workpiece grips 195 on the fingers 191.

Each of the grips include an arcuate groove 197. A series of opposed spaced angular blocks 199 are mounted upon each of the slide bars 91. These slidably support guide pins 201 which at their outer ends are pivotally connected at 203 to the corresponding fingers 191 and at their opposite ends extend through the respective blocks. The nuts 209 upon the respective guide pins are for adjustment. A coil spring 205 is mounted upon each guide pin and is interposed between block 199 and the corresponding finger 191. The nut 209 provides a means of regulating the compression of the springs 205 normally biasing the workpiece engaging fingers 191 into retaining engagement with the corresponding workpieces W.

Since the slide bars are limited to longitudinal reciprocal movements, they are secured together and spaced by the transverse end slide bar connectors 207, FIG. 5.

In operation, the respective workpiece gripper fingers 191 are biased into operative engagement with the respective workpieces W. Thus, fingers 191 are yieldable so that once the respective sequentially formed workpieces have been transferred to the next adjacent station and retained thereon in a conventional manner, the slide bars can return to their initial position merely by effecting a slight yielding retracting movement of the gripper fingers disengaging them from the workpieces.

The present invention is primarily directed to apparatus for utilizing a conventional straight side press so that by removal of the conventional die set, there can be substituted therefor a transfer unit applied to transfer work between stations.

The transfer unit includes feed mechanism in the form of walking beams or slide bars which are capable of longitudinal reciprocal movements needed in connection with the type of workpiece gripper fingers 191 shown in FIG. 5 or a compound movement transversely of the workpiece and longitudinally as shown by the translator construction of FIG. 4.

The invention also contemplates the method by which such straight side press can be used as a progressive die press, with standard material feeds remaining in place and converted to a transfer press by using the present transfer unit.

Thus, what might be expected from a very expensive transfer press amounting from 150,000 to 800,000 dollars or more can be accomplished by converting the present straight side press to a transfer press by using the transfer unit and retain all the other functions of a progressive die press. It can be reconverted to the conventional function of a straight side press by removing the transfer unit, FIG. 3, and replacing its conventional die set.

It is contemplated in both cases, that the conventional press construction will provide suitable feed means by which the stock, normally from a roll or strip, is initially fed into the press over the die set.

In a straight side press the stock normally would be moved to overlie the series of stations as in a progressive die and then be separated from the strip of stock at the last station. In the transfer unit the material required for the part is separated from the strip of material at the first station.

METHOD OF MODIFYING A STRAIGHT SIDE PRESS

The method includes removing and replacing the conventional die set with transfer unit 27, FIG. 3, including a plurality of longitudinally spaced sequential dies mounted upon the lower die shoe to define a series of stations, including an underlying sub-plate. A further step includes the securing of the sub-plate to the press bed.

Additional steps include:

Mounting and securing the upper die shoe to the press reciprocal slide, with the upper die shoe having a plurality of corresponding depending spaced sequential punches.

Mounting a pair of slide bars upon the lower die shoe outwardly of the sequential dies.

Providing opposed pairs of workpiece gripper fingers upon the slide bars in registry with each of the station.

Mounting a power operated translator upon the sub-plate, the translator having a longitudinally reciprocal slide mounting a side plate connected to the slide bars. A final step includes intermittently reciprocating the side plate and secured slide bars for intermittently and successively transferring the workpieces from station to station.

The foregoing method alternately includes intermittently feeding the side plate upon the slide transversely of its feed movements for simultaneously moving the slide bars successively towards and away from each other for moving the workpiece fingers into and out of engagement with the workpieces. The inward movement of the side plate is alternated with intermittent longitudinal movements of the slide after which the slide bars are retracted to disengage the workpiece fingers from the respective workpieces.

Straight side presses are used to form metal parts from flat stock fed from a coil, blanks and preforms. The purpose of the present transfer unit is to modify a conventional straight side press to perform transfer operations necessary in transfer work. On removing the transfer unit, the conventional die set is reassembled upon the press bed to utilize the conventional straight side press to again perform the operations of conventional progressive dies or other press operations.

It is contemplated that the present transfer unit may be applied to equivalent presses such as hydraulic presses, open back presses and gap frame presses.

As shown in FIG. 3, a plurality of fasteners 16, of which a plurality are used, are adapted to secure the transfer unit 27 upon the bed 15 and reciprocal slide 25. The same fasteners 16 are used for securing the conventional die set to the bed of the straight side press. Additional clamps, not shown, are often used to further anchor the die set or the present transfer unit to the straight side press.

UNIQUE FEATURES

1. The present Transfer Unit 27, FIG. 3, is completely self-contained, readily and easily removed and likewise reinstalled in 1–2 hours in most straight side presses.
2. The Transfer Unit is not limited to one feeding direction as transfer presses are. The Transfer Unit can be fed left to right, front to back, right to left or back to front. Multiple blank feeding is possible.
3. Transfer presses usually require 2–3 days die change-over time, the present Transfer Unit, being self-contained can be changed over in 1–2 hours, saves many downtime hours, and increases press uptime.
4. Transfer presses have all their drive mechanisms outside the die space and usually outside of the press frame. This style requires the transfer bars and related mechanism to become larger in reach capability to the stations in the die set. This added weight and inertia prohibits the maximum speed possible of most transfer presses. The present Transfer Unit, being a compact self-contained device reduces greatly the weights, mass and inertia of transfer bar mechanisms and consequently produces maximum press speeds and greater productivity.
5. These Transfer Units are not restricted by, or specifically related to, the individual press stroke as other transfer systems or other transfer presses. I.e. the Transfer Unit can be running in a 6″ stroke press, removed from this 6″ stroke press and reinstalled in a 12″ stroke press within two hours without any modification whatsoever.
6. The present Transfer Units utilize absolute and maintained contact of the parts being transferred at all times. Most other transfer systems and/or transfer presses use the release method to retract fingers and return transfer bar which allows the parts freedom to move from inertia or vibration.

In the art to date, the conventional progressive die press or straight side press, including gap frame presses, hydraulic and air presses cannot be modified for transfer functions; Nor can conventional transfer presses be modified for straight side press or progressive die functions.

The present transfer unit permits such modifications of the straight side press for transfer function.

Having described my invention, reference has now been made to the following claims:

I claim:

1. In a straight side press having a bed and a basic die set including a sub-plate removably secured upon said bed, a vertically reciprocal slide, a lower die shoe secured to said sub-plate, including a plurality of space dies, and a reciprocal upper die shoe removably secured to the slide and including a plurality of spaced punches, a power drive for reciprocating said slide and an apparatus for feeding a stock strip longitudinally onto said die;

the improvement of apparatus replacing the basic die set and sub-plate modifying the press to perform transfer functions by mounting a transfer unit upon the straight side press, said transfer unit comprising;

a die set assembly including a lower die shoe;

a sub-plate mounting said die shoe and secured to said bed along its length;

a plurality of longitudinally spaced sequential dies secured upon said lower die shoe defining a plurality of die stations;

a reciprocal upper die shoe connected to said reciprocal slide overlying and guidably positioned upon said lower die shoe and mounting a plurality of longitudinally spaced corresponding sequential punches for opertaive registry with said sequential dies respectively;

a pair of spaced elongated horizontal slide bars reciprocally mounted above said lower die shoe and arranged along and outwardly of said sequential dies;

opposed pairs of workpiece gripper fingers mounted upon said slide bars respectively and at their ends in registry with each station retainingly engageable with the respective sequentially formed workpiece at each work station;

means interconnecting said slide bars for movement in unison;

and a slide bar translator mounted upon said lower die shoe and secured to said slide bars for intermittently reciprocating said slide bars and fingers between adjacent stations, for sequentially transferring said workpieces through all stations;

said die set assembly including said slide bars and slide bar translator further comprising a transfer unit whose sub-plate, lower die shoe, slide bars and slide bar translator are secured to and removably mounted upon the bed of the straight side press for transfer operations and whose upper die shoe is removably secured upon the slide of the straight side press, said transfer unit replacing said basic die set and wherein upon removal of the transfer unit, the basic die set for the straight side press is successively reassembled upon and secured to the bed of said press and connected to said slide, said press operating as a straight side press.

2. In the method of modifying a straight side press having a bed and a basic die set including a sub-plate secured to said bed, a vertically reciprocal slide, a lower die shoe secured to said sub-plate and mounting a plurality of spaced dies and a reciprocal upper die shoe removably secured to the slide and including a plurality of spaced punches, in order to use the press for transfer functions, comprising the steps of:

disconnecting said sub-plate from said bed and removing said basic die set from said bed and from said vertical slide;

replacing the basic die set with a transfer unit including a die set assembly including a lower die shoe, a sub-plate mounting the die shoe, a plurality of longitudinally spaced sequentialdies mounted upon the lower die shoe defining a series of die stations and an upper die shoe having a plurality of depending punches, a pair of spaced reciprocal slide bars upon the lower die shoe outwardly of the dies, said slide bars having opposed pairs of workpiece gripper fingers in registry with each station adapted for intermittently and successively transferring the workpieces from station to station, and a power operated translator upon said sub-plate having a reciprocal slide mounting an intermittently reciprocal transversely adjustable side plate connected to the slide bars;

securing the sub-plate of the transfer unit of said bed; and securing the upper die shoe to the slide.

3. In the method of claim 2, a further step of disconnecting and removing the transfer unit from the straight side press and reassembling said basic die set including securing its sub-plate to the press bed and its upper die shoe to the slide, and wherein upon removal of the transfer unit, the basic die set for the straight side press is then operable as a straight side press.

* * * * *